US008715522B2

(12) United States Patent
Tokiai et al.

(10) Patent No.: US 8,715,522 B2
(45) Date of Patent: May 6, 2014

(54) REFRIGERATOR OIL COMPOSITION

(75) Inventors: Takeo Tokiai, Ichihara (JP); Masato Kaneko, Ichihara (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 378 days.

(21) Appl. No.: 12/664,833

(22) PCT Filed: Jun. 3, 2008

(86) PCT No.: PCT/JP2008/060189

§ 371 (c)(1),
(2), (4) Date: Dec. 15, 2009

(87) PCT Pub. No.: WO2008/152942

PCT Pub. Date: Dec. 18, 2008

(65) Prior Publication Data

US 2010/0176333 A1 Jul. 15, 2010

(30) Foreign Application Priority Data

Jun. 15, 2007 (JP) ..... 2007-158744

(51) Int. Cl.
*C09K 5/04* (2006.01)

(52) U.S. Cl.
USPC ..... 252/68

(58) Field of Classification Search
USPC ..... 252/68
See application file for complete search history.

(56) References Cited

U.S. PATENT DOCUMENTS

| | | | | |
|---|---|---|---|---|
| 5,543,068 | A | 8/1996 | Kaimai et al. | |
| 5,648,016 | A | 7/1997 | Klug et al. | |
| 5,711,896 | A | 1/1998 | Kaimai | |
| 6,080,705 | A | 6/2000 | Kaimai et al. | |
| 6,193,906 | B1 | 2/2001 | Kaneko et al. | |
| 6,260,380 | B1 * | 7/2001 | Arman et al. | 62/646 |
| 6,335,311 | B1 | 1/2002 | Namiki et al. | |
| 6,656,891 | B1 | 12/2003 | Sakanoue et al. | |
| 2002/0115577 | A1 | 8/2002 | Ohsumi et al. | |

FOREIGN PATENT DOCUMENTS

| | | | |
|---|---|---|---|
| CN | 1205029 | A | 1/1999 |
| CN | 1205357 | A | 1/1999 |
| CN | 1300316 | A | 6/2001 |
| CN | 1300316 | A | 6/2001 |
| EP | 0 533 165 | A1 | 3/1993 |
| EP | 0 861 883 | A2 | 9/1998 |
| EP | 0 861 883 | A3 | 9/1998 |
| EP | 1 028 156 | A1 | 8/2000 |
| JP | 4 55498 | | 2/1992 |
| JP | 5 320674 | | 12/1993 |
| JP | 7 173479 | | 7/1995 |
| JP | 7 507342 | | 8/1995 |
| JP | 8 337785 | | 12/1996 |
| JP | 10 8078 | | 1/1998 |
| JP | 10 46169 | | 2/1998 |
| JP | 10 237477 | | 9/1998 |
| JP | 11 323369 | | 11/1999 |
| JP | 2000 96075 | | 4/2000 |
| JP | 2006 503961 | | 2/2006 |
| JP | 2006 512426 | | 4/2006 |
| WO | 2006 094303 | | 9/2006 |

OTHER PUBLICATIONS

Extended Search Report issued Jun. 1, 2011 in Europe Application No. 08765002.4.
Chinese Office Action issued Mar. 30, 2012, in Patent Application No. 200880020017.6 (with English-language translation).
Combined Chinese Office Action and Search Report Issued Jan. 14, 2013 in Patent Application No. 200880020017.6 (with English translation).
Office Action issued Sep. 11, 2013 in *Taiwanese* Patent Application No. 097122277 (with English translation).
Office Action issued Sep. 11, 2013 in Chinese Patent Application No. 097122277 (with English translation).

* cited by examiner

*Primary Examiner* — John Hardee
(74) *Attorney, Agent, or Firm* — Oblon, Spivak, McClelland, Maier & Neustadt, L.L.P.

(57) ABSTRACT

A refrigerator oil composition contains base oil and polyalkylene glycol (PAG) block copolymer. The PAG block polymer is represented by the following formula (1).

$$R^1[(OR^2)_m(OE)_nOR^3]_l \quad (1)$$

In the formula: $R^1$ represents a hydrocarbon residue having 1 to 10 carbon atoms; $R^2$ represents an alkenyl group having 3 to 6 carbon atoms; E represents an ethylene group; $R^3$ represents a hydrogen atom or an alkyl group having 1 to 10 carbon atoms; m and n each represent a positive integer, a ratio of m to n (m/n) being 99/1 to 50/50; and l represents an integer in a range of 1 to 100.

13 Claims, No Drawings

REFRIGERATOR OIL COMPOSITION

This application is a 371 of PCT/JP08/60189 filed Jun. 3, 2008. Priority to Japanese patent application 2007-158744, filed Jun. 15, 2007, is claimed.

TECHNICAL FIELD

The present invention relates to a refrigerator oil composition used in a compression freezer(s) of various freezer fields.

BACKGROUND ART

In general, a compression freezer includes a compressor, a condenser, an expansion valve and an evaporator. Within an enclosed system of the compression freezer, a liquid mixture of a refrigerant and lubricating oil is circulated. An example of a refrigerant conventionally used in many of such compression freezers is chlorofluorocarbon such as dichlorodifluoromethane (R12) or chlorodifluoromethane (R22). On the other hand, examples of the lubricating oil conventionally used therein are a variety of mineral oil and synthetic oil.

However, chlorofluorocarbon as mentioned above may bring about an environmental pollution such as destruction of the stratospheric ozone layer, a use of which has been more strictly regulated on a global scale in recent years. Thus, a hydrogen-containing chlorofluorocarbon compound such as hydrofluorocarbon or hydrochlorofluorocarbon is attracting more and more attentions as a new refrigerant. Such a hydrogen-containing chlorofluorocarbon compound, especially hydrofluorocarbon represented by R134a, is a preferable refrigerant for compression freezers not only because the compound does not destroy the ozone layer but also because the compound can be used in conventional freezers in place of conventional chlorofluorocarbon such as R12 without requiring configurations of the conventional freezers to be changed (e.g., see Patent Document 1).

On the other hand, since hydrofluorocarbon may also bring about an impact on the environment in terms of global warming, a so-called natural refrigerant such as carbon dioxide or ammonia is also attracting more and more attractions as an alternative refrigerant that is more suitable for environmental protection. Refrigerator oil using such a natural refrigerant has been also proposed (e.g., see Patent Document 2). In addition, a refrigerant having a specific polar structure in its molecule such as an unsaturated fluorohydrocarbon compound, a fluoroether compound, a fluoroalcohol compound or a fluoroketone compound has been found to have lower global warming potential (e.g., see Patent Documents 3 and 4).

Patent Document 1: JP-A-10-008078
Patent Document 2: JP-2000-96075
Patent Document 3: JP-T-2006-503961
Patent Document 4: JP-T-07-507342

DISCLOSURE OF THE INVENTION

Problems to be Solved by the Invention

However, the refrigerator oil disclosed in Patent Document 1 or 2 is not necessarily sufficiently superior in terms of energy saving. For instance, even when the refrigerator oil is used in a freezer such as a car air-conditioner or an electric refrigerator, friction between an aluminum product and a steel product of the freezer remains large, which is problematic in terms of energy saving. In addition, since a great variety of refrigerants are available as described above, it has been difficult to provide refrigerator oil that is widely applicable to freezers each of which employs a different refrigerant.

An object of the present invention is to provide a refrigerator oil composition widely applicable to compression freezers that use refrigerant(s) such as: hydrofluorocarbon; a natural refrigerant such as hydrocarbon, carbon dioxide or ammonium; a refrigerant mixture of fluoromethyl iodide and propene; unsaturated fluorohydrocarbon; fluoroether; fluoroalcohol; fluoroketone; or a mixture(s) thereof, the oil composition having a low friction coefficient and being excellent in terms of energy saving.

Means for Solving the Problems

In order to solve the above-mentioned problems, according to an aspect of the present invention, refrigerator oil compositions as follows are provided:

[1] a refrigerator oil composition, containing base oil; and a polyalkylene glycol (PAG) block copolymer, in which the PAG block copolymer is represented by a formula (1) as follows.

$$R^1[(OR^2)_m(OE)_nOR^3]_l \quad (1)$$

In the formula (1), $R^1$ represents a hydrocarbon residue having 1 to 10 carbon atoms, $R^2$ represents an alkylene group having 3 to 6 carbon atoms, E represents an ethylene group, $R^3$ represents a hydrogen atom or an alkyl group having 1 to 10 carbon atoms, m and n each represent a positive integer, a ratio of m/n being 99/1 to 50/50, and l represents an integer in a range of 1 to 100;

[2] the above-described refrigerator oil composition, in which a mass average molecular weight of the PAG block copolymer is 200 to 5,000;

[3] the above-described refrigerator oil composition, in which the PAG block copolymer is contained in the refrigerator oil composition with a content of 0.05 to 10 mass % of the total amount of the refrigerator oil composition;

[4] the above-described refrigerator oil composition, in which the base oil is mineral oil and/or synthetic base oil, and the synthetic base oil is at least one compound selected from a group consisting of alkyl benzene, alkyl naphthalene, poly-α-olefin, polyvinyl ether, polyalkylene glycol, polycarbonate, polyol ester and an ether-base compound represented by a formula (2) as follows.

$$Ra\text{-}[(ORb)n\text{-}(A)\text{-}(ORc)k]x\text{-}Rd \quad (2)$$

In the formula (2): Ra and Rd each represent a hydrogen atom, an alkyl group having 1 to 10 carbon atoms, an acyl group having 2 to 10 carbon atoms or a hydrocarbon group having 2 to 6 bonding sites and 1 to 10 carbon atoms; Rb and Rc each represent an alkylene group having 2 to 4 carbon atoms; n and k each represent an integer in a range of 0 to 20; x represents an integer in a range of 1 to 6; and (A) represents a polymerization site comprising three or more monomer units each represented by a formula (3) as follows.

[Chemical Formula 1]

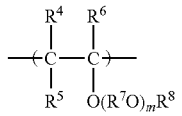

(3)

In the formula (3): $R^4$, $R^5$ and $R^6$ each represent a hydrogen atom or a hydrocarbon group having 1 to 8 carbon atoms, and $R^4$, $R^5$ and $R^6$ may be mutually the same or different; $R^7$ represents a divalent hydrocarbon group having 1 to 10 carbon atoms or a divalent ether-bonded oxygen-containing hydrocarbon group having 2 to 20 carbon atoms; $R^8$ represents a hydrogen atom or a hydrocarbon group having 1 to 20 carbon atoms; m represents a number whose average value is in a range of 0 to 10; when plural m are present, the plural m may be mutually the same or different per unit; $R^4$ to $R^8$ each may be mutually the same or different per unit; when plural $R^7O$ are present, the plural $R^7O$ may be mutually the same or different; and when k and n in the formula (2) both represent 0, one of plural m in the formula (3) represents an integer of 1 or more;

[5] the above-described refrigerator oil composition, further containing at least one additive selected from a group consisting of an extreme pressure agent, an oiliness agent, an antioxidant, an acid scavenger, a copper deactivator and an antifoaming agent;

[6] the above-described refrigerator oil composition, in which kinematic viscosity of the refrigerator oil composition at 40 degrees C. is 1 to 400 $mm^2/s$; and

[7] the above-described refrigerator oil composition, in which a friction coefficient of the refrigerator oil composition is 0.119 or less, the friction coefficient being obtained through a reciprocating friction test.

According to the present invention, the refrigerator oil composition is applicable to compression freezers that use refrigerant(s) such as: hydrofluorocarbon; a natural refrigerant such as hydrocarbon, carbon dioxide or ammonium; a refrigerant mixture of fluoromethyl iodide and propene; unsaturated fluorohydrocarbon; fluoroether; fluoroalcohol; fluoroketone; or a mixture(s) thereof, and the refrigerator oil composition has a low friction coefficient and is excellent in terms of energy saving.

BEST MODE FOR CARRYING OUT THE INVENTION

A preferred embodiment for implementing the present invention will be described below.

The refrigerator oil composition according to the present invention contains base oil and a PAG block copolymer. The base oil may be mineral oil or synthetic base oil. The synthetic base oil is preferably at least one synthetic base oil selected from a group consisting of alkyl benzene, alkyl naphthalene, poly-α-olefin, polyvinyl ether, polyalkylene glycol, polycarbonate, polyol ester and an ether-base compound represented by the formula (2).

First of all, the base oil will be described below.

(1) Mineral Oil

The mineral oil is preferably highly-refined mineral oil, examples of which are: refined oil provided by refining oil fractions in accordance with an ordinary method; deeply-dewaxed oil provided by deeply dewaxing the refined oil fractions; and hydrotreated oil provided by hydrotreating the oil fractions, the oil fractions being provided by atmospherically distilling paraffin-base crude oil, intermediate-base crude oil or naphthene-base crude oil or by vacuum-distilling the residual oil of the atmospherically-distilled oil. The method of refining is not particularly limited but various methods may be employed.

In general, a treatment such as (a) hydrotreating, (b) dewaxing (solvent-dewaxing or hydrodewaxing), (c) solvent-extracting, (d) alkali-distilling or sulfate-cleaning or (e) clay-treating is singularly performed, or plural methods thereof are combinationally performed in a suitable order. In addition, performing the same treatment plural times is also effective. For instance, the oil fractions may experience hydrotreating, the oil fractions may initially experience hydrotreating and subsequently alkali-distilling or sulfate-cleaning, the oil fractions may initially experience hydrotreating and subsequently dewaxing, the oil fractions may initially experience solvent-extracting and subsequently hydrotreating, the oil fractions may experience hydrotreating twice or three times, the oil fractions may initially experience hydrotreating twice or three times and subsequently alkali-distilling or sulfate-cleaning, or the oil fractions may initially experience the above-described treatment(s) and subsequently dewaxing again (i.e., deep dewaxing). Among the above-described methods, the mineral oil provided by deep dewaxing is preferable for the highly-refined mineral oil used as the base oil in the present invention because such mineral oil is excellent in low-temperature fluidity and free from wax precipitation at low temperatures. According to the deep dewaxing, the oil fractions are solvent-dewaxed under severe conditions or the oil fractions are catalytic-dewaxed using a zeolite catalyst.

When the mineral oil is used as the base oil of the refrigerator oil composition according to the present invention, its kinematic viscosity at 40 degrees C. is preferably 1 to 400 $mm^2/s$, more preferably 5 to 250 $mm^2/s$.

(2) Alkyl Benzene

Examples of the alkyl benzene are any alkyl benzene usable for refrigerator oil, among which alkyl benzene having high viscosity is preferably used for the present invention. Although there is a variety of such highly-viscous alkyl benzene, alkyl benzene whose alkyl group has 20 or more carbon atoms in total (or alkyl benzene whose plurality of alkyl groups has 20 or more carbon atoms in sum total) such as monoalkyl benzene, dialkyl benzene or trialkyl benzene is preferable. Alkyl benzene having two or more alkyl groups in which 20 or more carbon atoms are contained in sum total (e.g., dialkyl benzene) is more preferably used in view of thermal stability. As long as kinematic viscosity of the highly-viscous alkyl benzene is within the above-described range, the highly-viscous alkyl benzene may be singularly used or two or more of the above examples may be mixed to be used.

When alkyl benzene is used as the base oil of the refrigerator oil composition according to the present invention, its kinematic viscosity at 40 degrees C. is preferably 1 to 400 $mm^2/s$, more preferably 5 to 250 $mm^2/s$.

(3) Alkyl Naphthalene

A preferable example of the alkyl naphthalene is alkyl naphthalene whose naphthalene ring is bonded with two or three alkyl groups. Particularly, alkyl naphthalene having 20 or more carbon atoms in total is more preferable in view of thermal stability. In the present invention, the alkyl naphthalene may be singularly used or a mixture thereof may be used.

When alkyl naphthalene is used as the base oil of the refrigerator oil composition according to the present invention, its kinematic viscosity at 40 degrees C. is preferably 1 to 400 $mm^2/s$, more preferably 5 to 250 $mm^2/s$.

(4) Poly-α-Olefin

Although there is a variety of usable poly-α-olefin, the poly-α-olefin is typically an α-olefin polymer having 8 to 18 carbon atoms. The poly-α-olefin polymer is preferably a 1-dodecene polymer, a 1-decene polymer or a 1-octene polymer in view of thermal stability, sealability, lubricity and the like. In the present invention, hydrotreated poly-α-olefin is preferably used as the poly-α-olefin in view of thermal stability. The poly-α-olefin may be singularly used or a mixture thereof may be used.

When poly-α-olefin is used as the base oil of the refrigerator oil composition according to the present invention, its kinematic viscosity at 40 degrees C. is preferably 1 to 400 $mm^2/s$, more preferably 5 to 250 $mm^2/s$.

(5) Polyvinyl Ether-Base Compound

Examples of the polyvinyl ether-base compound used as the base oil are a compound prepared by polymerizing vinyl ether monomer (hereinafter called as polyvinyl ether I), a compound prepared by copolymerizing vinyl ether monomer and hydrocarbon monomer having olefin double-bond(s) (hereinafter called as polyvinyl ether copolymer II), and a copolymer of polyvinyl ether and alkylene glycol, polyalkylene glycol or monoether thereof (hereinafter called as polyvinyl ether copolymer III).

Examples of vinyl ether monomer used as the material of the polyvinyl ether I are vinyl methyl ether, vinyl ethyl ether, vinyl-n-propyl ether, vinyl isopropyl ether, vinyl-n-butyl ether, vinyl-isobutyl ether, vinyl-sec-butyl ether, vinyl-tert-butyl ether, vinyl-n-pentyl ether, vinyl-n-hexyl ether, vinyl-2-methoxymethyl ether, vinyl-2-ethoxyethyl ether, vinyl-2-methoxy-1-methylethyl ether, vinyl-2-methoxy-propyl ether, vinyl-3,6-dioxaheptyl ether, vinyl-3,6,9-trioxadecyl ether, vinyl-1,4-dimethyl-3,6-dioxaheptyl ether, vinyl-1,4,7-trimethyl-3,6,9-trioxadecyl ether, vinyl-2,6-dioxa-4-heptyl ether, vinyl-2,6,9-trioxa-4-decyl ether, 1-methoxypropene, 1-ethoxypropene, 1-n-propoxypropene, 1-isopropoxypropene, 1-n-butoxypropene, 1-isobutoxypropene, 1-sec-butoxypropene, 1-tert-butoxypropene, 2-methoxypropene, 2-ethoxypropene, 2-n-propoxypropene, 2-isopropoxypropene, 2-n-butoxypropene, 2-isobutoxypropene, 2-sec-butoxypropene, 2-tert-butoxypropene, 1-methoxy-1-butene, 1-ethoxy-1-butene, 1-n-propoxy-1-butene, 1-isopropoxy-1-butene, 1-n-butoxy-1-butene, 1-isobutoxy-1-butene, 1-sec-butoxy-1-butene, 1-tert-butoxy-1-butene, 2-methoxy-1-butene, 2-ethoxy-1-butene, 2-n-propoxy-1-butene, 2-isopropoxy-1-butene, 2-n-butoxy-1-butene, 2-isobutoxy-1-butene, 2-sec-butoxy-1-butene, 2-tert-butoxy-1-butene, 2-methoxy-2-butene, 2-ethoxy-2-butene, 2-n-propoxy-2-butene, 2-isopropoxy-2-butene, 2-n-butoxy-2-butene, 2-isobutoxy-2-butene, 2-sec-butoxy-2-butene, 2-tert-butoxy-2-butene and the like. The above vinyl ether-base monomers can be manufactured by a known method.

One of the above vinyl ether monomers may be singularly used or a combination of two or more thereof may be used.

The vinyl ether monomers listed above each may be also used as the material for the polyvinyl ether copolymer II. One of the above vinyl ether monomers may be singularly used or a combination of two or more thereof may be used.

Examples of the hydrocarbon monomer having olefin double-bond(s), which is the other material of the polyvinyl ether copolymer II, are ethylene, propylene, butenes, pentenes, hexenes, heptenes, octenes, diisobutylene, triisobutylene, styrene, α-methylstyrene, alkyl-substituted styrenes and the like.

One of the above hydrocarbon monomers having olefin double-bond(s) may be singularly used or a combination of two or more thereof may be used. The polyvinyl ether copolymer II may be a block copolymer or a random copolymer.

The polyvinyl ether I and the polyvinyl ether copolymer II can be manufactured exemplarily by the following method.

At the initial stage of the polymerization, a compound prepared by combining Bronsted acids, Lewis acids or organometallic compounds with water, alcohols, phenols, acetals or an adduct of vinyl ethers and a carboxylic acid may be used. Examples of the Bronsted acids are hydrofluoric acid, hydrochloric acid, hydrobromic acid, hydroiodic acid, nitric acid, sulfuric acid, trichloroacetic acid, trifluoroacetic acid and the like. Examples of the Lewis acids are boron trifluoride, aluminum trichloride, aluminum tribromide, tin tetrachloride, zinc dichloride, ferric chloride and the like, among which boron trifluoride is particularly preferable. Examples of the organometallic compounds are diethylaluminum chloride, ethylaluminum chloride, diethylzinc and the like.

An initiating terminal of the polymer, from which the polymerization of the polymer is initiated, is a hydrogen atom when water, alcohols or phenols is used. On the other hand, when acetals is used, the initiating terminal is a hydrogen atom or a residue formed by eliminating one of alkoxy groups from the used acetals. In addition, when the adduct of vinyl ethers and carboxylic acid is used, the initiating terminal is a residue formed by eliminating an alkylcarbonyloxy group originated in the carboxylic acid from the adduct of vinyl ethers and carboxylic acid.

On the other hand, an end terminal, at which the polymerization of the polymer is ended, is acetal, olefin or aldehyde when water, alcohols, phenols or acetals is used. When the adduct of vinyl ether and carboxylic acid is used, the end terminal is carboxylic ester of hemiacetal. The terminals of the polymer as described above may be substituted by desirable group(s) by a known method. Examples of the desirable group(s) are a saturated hydrocarbon residue, an ether residue, an alcohol residue, a ketone residue, a nitril residue and an amid residue, among which a saturated hydrocarbon residue, an ether residue and an alcohol residue are preferable.

Although depending on materials and initiators to be used, reaction of the polymerization can be initiated within a temperature range of −80 to 150 degrees C., typically within a temperature range of −80 to 50 degrees C. The reaction of the polymerization is ended in ten seconds to ten hours after the initiation of the reaction. The reaction of the polymerization is usually conducted under the presence of solvent. The solvent is not particularly limited as long as a sufficient amount of the reaction material can be dissolved in the solvent and the solvent is inactive against the reaction. Hydrocarbon-base solvent such as hexane, benzene or toluene and ether-base solvent such as ethyl ether, 1,2-dimethoxyethane or tetrahydrofuran can be preferably used.

On the other hand, the polyvinyl ether copolymer III can be manufactured by using alkylene glycol, polyalkylene glycol or monoether thereof as the initiator and polymerizing the vinyl ether monomer in accordance with the above polymerizing method.

Examples of the alkylene glycol, the polyalkylene glycol or the monoether thereof are alkylene glycol or polyalkylene glycol such as ethylene glycol, diethylene glycol, triethylene glycol, polyethylene glycol, propylene glycol, dipropylene glycol, tripropylene glycol or polypropylene glycol, and alkylene glycol monoether or polyalkylene glycol monoether such as ethylene glycol monomethylether, diethylene glycol monomethylether, triethylene glycol monomethylether, propylene glycol monomethylether, dipropylene glycol monomethylether, or tripropylene glycol monomethylether.

The vinyl ether monomers listed in the description of the polyvinyl ether I may be used as the materials for the polyvinyl ether copolymer III. One of the above vinyl ether monomers may be singularly used or a combination of two or more thereof may be used.

In the present invention, one of the above polyvinyl ether-base compounds may be singularly used or a combination of two or more thereof may be used.

When the polyvinyl ether-base compound(s) is used as the base oil of the refrigerator oil composition according to the present invention, its kinematic viscosity at 40 degrees C. is preferably 1 to 400 $mm^2/s$, more preferably 5 to 250 $mm^2/s$.

(6) Polyalkylene Glycol-Base Compound

An example of the polyalkylene glycol-base compound used in the base oil of the refrigerator oil composition according to the present invention is a compound represented by the following formula (4).

$$R^9—[(OR^{10})_{m1}—OR^{11}]_{n1} \quad (4)$$

In the formula, $R^9$ represents a hydrogen atom, an alkyl group having 1 to 10 carbon atoms, an acyl group having 2 to 10 carbon atoms or an aliphatic hydrocarbon group having 2 to 6 bonding sites and 1 to 10 carbon atoms, $R^{10}$ represents an alkylene group having 2 to 4 carbon atoms, $R^{11}$ represents a hydrogen atom, an alkyl group having 1 to 10 carbon atoms or an acyl group having 2 to 10 carbon atoms, n1 represents an integer in a range of 1 to 6, and m1 represents a number that is determined such that the average value of m1 multiplied by n1 is in a range of 6 to 80.

In the formula (4), the alkyl groups represented by $R^9$ and $R^{11}$ each may be linear, branched or cyclic. Examples of the alkyl groups are a methyl group, an ethyl group, an n-propyl group, an isopropyl group, butyl groups, pentyl groups, hexyl groups, heptyl groups, octyl groups, nonyl groups, decyl groups, a cyclopentyl group, a cyclohexyl group and the like. When the number of the carbon atoms contained in the alkyl group(s) exceeds 10, compatibility of the base oil with the refrigerant is deteriorated, so that a crude separation may occur. The alkyl group(s) preferably has 1 to 6 carbon atoms.

In addition, alkyl groups of the acyl groups represented by $R^9$ and $R^{11}$ each may be linear, branched or cyclic. Examples of the alkyl groups of the acyl groups are the same groups as listed in the above description of the alkyl groups. The examples of the alkyl groups of the acyl groups each has 1 to 9 carbon atoms. When the number of the carbon atoms contained in the acyl group(s) exceeds 10, compatibility of the base oil with the refrigerant is deteriorated, so that a crude separation may occur. The acyl group(s) preferably has 2 to 6 carbon atoms.

When $R^9$ and $R^{11}$ each represent an alkyl group or an acyl group, $R^9$ and $R^{11}$ may be mutually the same or different.

In addition, when n1 is 2 or more, plural $R^9$ included in one molecule may be the same or mutually different.

When $R^9$ is an aliphatic hydrocarbon group having 2 to 6 bonding sites and 1 to 10 carbon atoms, the aliphatic hydrocarbon group may be linear or cyclic. Examples of the aliphatic hydrocarbon group having 2 bonding sites are an ethylene group, a propylene group, a butylene group, a pentylene group, a hexylene group, a heptylene group, an octylene group, a nonylene group, a decylene group, a cyclopentylene group, a cyclohexylene group and the like. An example of an aliphatic hydrocarbon group having 3 to 6 bonding sites is a residue formed by eliminating a hydroxyl group from multivalent alcohol such as trimethyl propane, glycerin, pentaerythritol, sorbitol, 1,2,3-trihydroxycyclohexane, or 1,3,5-trihydroxycyclohexane.

When the number of the carbon atoms contained in the aliphatic hydrocarbon group exceeds 10, compatibility of the base oil with the refrigerant is deteriorated, so that a crude separation may occur. The aliphatic hydrocarbon group preferably has 2 to 6 carbon atoms.

In the formula (4), $R^{10}$ represents an alkylene group having 2 to 4 carbon atoms. Examples of an oxyalkylene group, which is a repeating unit of the alkylene group, are an oxyethylene group, an oxypropylene group, an oxybutylene group and the like. Although a plurality of oxyalkylene groups included in one molecule may be mutually the same or different, at least one oxypropylene group is preferably included in one molecule. More preferably, an oxypropylene unit is contained in an oxyalkylene unit with a content of 50 mol % or more.

In the formula (4), n1, which represents an integer in a range of 1 to 6, is determined in accordance with the number of the bonding sites of $R^9$. For instance, n1 is 1 when $R^9$ is an alkyl group or an acyl group while n1 is 2, 3, 4, 5 or 6 when $R^9$ is an aliphatic hydrocarbon group having 2, 3, 4, 5 or 6 bonding sites respectively. In addition, m1 is determined so that the average value of m1 multiplied by n1 is in a range of 6 to 80. When the average value of m1 multiplied by n1 is not in the above range, an object of the present invention will not be sufficiently achieved.

The polyalkylene glycol-base compound represented by the formula (4) contains polyalkylene glycol having hydroxyl groups at its terminals. As long as the content of the hydroxyl groups is 50 mol % or less of the total terminal groups, the polyalkylene glycol containing the hydroxyl groups can be preferably used. When the content of the hydroxyl groups is more than 50 mol %, hygroscopicity is unfavorably increased, such that viscosity index is decreased.

Polyalkylene glycols such as polypropylene glycol dimethylether, polyoxyethylene, polypropylene glycol dimethylether, polypropylene glycol monobutylether or polypropylene glycol diacetate are preferable in view of cost and effects.

The polyalkylene glycol-base compound represented by the formula (4) may be any one of the compounds described in detail in JP-A-02-305893.

In the present invention, one of the polyalkylene glycol-base compounds may be singularly used or a combination of two or more thereof may be used.

When the polyalkylene glycol-base compound(s) is used as the base oil of the refrigerator oil composition according to the present invention, its kinematic viscosity at 40 degrees C. is preferably 1 to 400 $mm^2/s$, more preferably 5 to 250 $mm^2/s$.

(7) Polycarbonate-Base Compound

A polycarbonate-base compound used in the base oil of the refrigerator oil composition according to the present invention is preferably polycarbonate having two or more carbonate bonds in one molecule, i.e., at least one compound selected from a group consisting of a compound represented by the following formula (5) and a compound represented by the following formula (6).

[Chemical Formula 2]

$$Z-\{O-\overset{\overset{\displaystyle O}{\|}}{C}-O-[(R^{12}O)_a-\overset{\overset{\displaystyle O}{\|}}{C}-O]_b-R^{13}\}_c \quad (5)$$

In the formula: Z represents a residue formed by eliminating a hydroxyl group from c-valent alcohol having 1 to 12 carbon atoms; $R^{12}$ represents a linear or branched alkylene group having 2 to 10 carbon atoms; $R^{13}$ represents a monovalent hydrocarbon group having 1 to 12 carbon atoms or a group containing an ether bond represented by $R^{15}(O—R^{14})d$-, where $R^{15}$ represents a hydrogen atom or a monovalent hydrocarbon group having 1 to 12 carbon atoms, $R^{14}$ represents a linear or branched alkylene group having 2 to 10 carbon atoms, and d represents an integer in a range of 1 to 20; a represents an integer in a range of 1 to 30; b represents an integer in a range of 1 to 50; and c represents an integer in a range of 1 to 6.

[Chemical Formula 3]

$$Z-\{O(R^{16}O)_e-\overset{\overset{\displaystyle O}{\|}}{C}-O-[(R^{12}O)_a-\overset{\overset{\displaystyle O}{\|}}{C}-O]_b-R^{13}\}_c \quad (6)$$

In the formula, $R^{16}$ represents a linear or branched alkylene group having 2 to 10 carbon atoms; e represents an integer in a range of 1 to 20; and Z, $R^{12}$, $R^{13}$, a, b and c each represent the same as in the above.

In the formulae (5) and (6), Z represents a residue formed by eliminating a hydroxyl group from 1 to 6-valent alcohol having 1 to 12 carbon atoms. More preferably, Z represents a residue formed by eliminating a hydroxyl group from monovalent alcohol having 1 to 12 carbon atoms.

Examples of 1 to 6-valent alcohol having 1 to 12 carbon atoms, whose residue corresponds to Z, are: monovalent alcohol such as monovalent aliphatic alcohol exemplified by methyl alcohol, ethyl alcohol, n- or isopropyl alcohol, butyl alcohols, pentyl alcohols, hexyl alcohols, octyl alcohols, decyl alcohols and dodecyl alcohols, monovalent alicyclic alcohol exemplified by cyclopentyl alcohol and cyclohexyl alcohol, aromatic alcohol exemplified by phenol, cresol, xylenol, butylphenol and naphthol, or aromatic aliphatic alcohol exemplified by benzyl alcohol and phenethyl alcohol; divalent alcohol such as aliphatic alcohol exemplified by ethylene glycol, propylene glycol, butylene glycol, neo-pentylene glycol and tetramethylene glycol, alicyclic alcohol exemplified by cyclohexanediol and cyclohexanedimethanol, or aromatic alcohol exemplified by catechol, resorcinol, hydroquinone and dihydroxydiphenyl; trivalent alcohol such as aliphatic alcohol exemplified by glycerin, trimethylolpropane, trimethylolethane, trimethylolbutane and 1,3,5-pentanetriol, alicyclic alcohol exemplified by cyclohexanetriol and cyclohexanetrimethanol, or aromatic alcohol exemplified by pyrogallol and methylpyrogallol; and 4 to 6-valent alcohol such as aliphatic alcohol exemplified by pentaerythritol, diglycerin, triglycerin, sorbitol and dipentaerythritol.

An example of the polycarbonate compound represented by the formula (5) is a compound represented by the formula (5-a), and/or an example of the polycarbonate compound represented by the formula (6) is a compound represented by the formula (6-a).

[Chemical Formula 4]

(5-a)

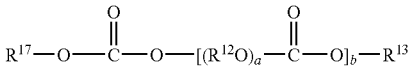

In the formula, $R^{17}$ represents a residue formed by eliminating a hydroxyl group from monovalent alcohol having 1 to 12 carbon atoms, and $R^{12}$, $R^{13}$, a and b each represents the same as above.

[Chemical Formula 5]

(6-a)

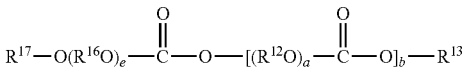

In the formula, $R^{12}$, $R^{13}$, $R^{16}$, $R^{17}$, a, b and e each represent the same as above.

In the formulae (5-a) and (6-a), examples of the residue represented by $R^{17}$ (the residue formed by eliminating a hydroxyl group from monovalent alcohol having 1 to 12 carbon atoms) are an aliphatic hydrocarbon group such as a methyl group, an ethyl group, an n-propyl group, an isopropyl group, butyl groups, pentyl groups, hexyl groups, octyl groups, decyl groups or dodecyl groups, an alicyclic hydrocarbon group such as a cyclopentyl group, a cyclohexyl group, a methylcyclohexyl group, a dimethylcyclohexyl group or a decahydronaphthyl group, an aromatic hydrocarbon group such as a phenyl group, tolyl groups, xylyl groups, a mesityl group or naphthyl groups, and aromatic aliphatic hydrocarbon group such as a benzyl group, a methyl benzyl group, a phenethyl group or naphthylmethyl groups. Among the above, a linear or branched alkyl group having 1 to 6 carbon atoms is preferable.

$R^{12}$ represents a linear or branched alkylene group having 2 to 10 carbon atoms. The alkylene group preferably has 2 to 6 carbon atoms. In addition, an ethylene group and a propylene group are particularly preferable in view of performance and manufacturing simplicity. $R^{13}$ represents a monovalent hydrocarbon group having 1 to 12 carbon atoms or a group containing an ether bond represented by $R^{15}(O—R^{14})d$-. where $R^{15}$ represents a hydrogen atom or a monovalent hydrocarbon group having 1 to 12 carbon atoms (preferably 1 to 6 carbon atoms), $R^{14}$ represents a linear or branched alkylene group having 2 to 10 carbon atoms, and d represents an integer in a range of 1 to 20. Examples of the monovalent hydrocarbon group having 1 to 12 carbon atoms are the same as those listed in the description of $R^{17}$. The linear or branched alkylene group having 2 to 10 carbon atoms represented by $R^{14}$ preferably has 2 to 6 carbon atoms for the same reason as described in relation to $R^{12}$. In addition, an ethylene group and a propylene group are particularly preferable.

$R^{13}$ preferably represents a linear or branched alkyl group having 1 to 6 carbon atoms.

The linear or branched alkylene group having 2 to 10 carbon atoms represented by $R^{14}$ in the general formula (6-a) preferably has 2 to 6 carbon atoms for the same reason as described in relation to $R^{12}$. In addition, an ethylene group and a propylene group are particularly preferable.

Although a variety of methods of manufacturing is available for the above polycarbonate-base compound, a target polycarbonate-base compound can be typically manufactured by reacting a carbonate ester-forming derivative (e.g., carbonate diester, phosgene or the like) with alkylene glycol or polyoxyalkylene glycol in accordance with a known method.

In the present invention, one of the polycarbonate-base compounds may be singularly used or a combination of two or more thereof may be used.

When the polycarbonate-base compound(s) is used as the base oil of the refrigerator oil composition according to the present invention, its kinematic viscosity at 40 degrees C. is preferably 1 to 400 $mm^2/s$, more preferably 5 to 250 $mm^2/s$.

(8) Polyol Ester-Base Compound

An example of an polyol ester-base compound used in the base oil of the refrigerator oil composition according to the present invention is ester of polyol having approximately 3 to 20 diols or hydroxyl groups and aliphatic acid having approximately 1 to 24 carbon atoms. Examples of the diol are ethylene glycol, 1,3-propanediol, propylene glycol, 1,4-butanediol, 1,2-butanediol, 2-methyl-1,3-propanediol, 1,5-pentanediol, neopentyl glycol, 1,6-hexanediol, 2-ethyl-2-methyl-1,3-propanediol, 1,7-heptanediol, 2-methyl-2-propyl-1,3-propanediol, 2,2-diethyl-1,3-propanediol, 1,8-octanediol, 1,9-nonanediol, 1,10-decanediol, 1,11-undecanediol, 1,12-dodecanediol and the like. Examples of the polyol are multivalent alcohol such as trimethylolethane, trimethylolpropane, trimethylolbutane, di-(trimethylolpropane), tri-(trimethylolpropane), pentaerythritol, di-(pentaerythritol), tri-(pentaerythritol), glycerin, polyglycerin (2 to 20-meric glycerin), 1,3,5-pentanetriol, sorbitol, sorbitan, sorbitol-glycerin condensation, adonitol, arabitol, xylitol or mannitol, sugars such as xylose, arabinose, ribose, rhamnose, glucose, fructose, galactose, mannose, sorbose, cellobiose, maltose, isomaltose, trehalose, sucrose, raffinose, gentianose or melezitose, partially-etherified compounds of the above, methyl glucoside (glycoside) and the like. Among the above, the polyol is preferably hindered alcohol such as neopentyl glycol, trimethylol ethane, trimethylol propane, trimethylol butane, di-(trimethylol propane), tri-(trimethylol propane), pentaerythritol, di-(pentaerythritol) or tri-(pentaerythritol).

Although the number of the carbon atoms contained in the aliphatic acid(s) is not subject to any specific limitations, aliphatic acid(s) having 1 to 24 carbon atoms is typically used. Among the aliphatic acids having 1 to 24 carbon atoms, an aliphatic acid having 3 or more carbon atoms is preferable in view of lubricity, an aliphatic acid having 4 or more carbon atoms is more preferable, an aliphatic acid having 5 or more carbon atoms is further more preferable, and an aliphatic acid having 10 or more carbon atoms is the most preferable. In addition, in view of compatibility of the base oil with the refrigerant, an aliphatic acid having 18 or less carbon atoms is preferable, an aliphatic acid having 12 or less carbon atoms is more preferable, and an aliphatic acid having 9 or less carbon atoms is further more preferable.

The aliphatic acid may be linear or branched. The aliphatic acid is preferably linear in view of lubricity while the aliphatic acid is preferably branched in view of hydrolytic stability. Further, the aliphatic acid may be saturated or unsaturated.

Examples of the aliphatic acid are linear or branched acids such as a pentane acid, a hexane acid, a heptane acid, an octane acid, a nonane acid, a decane acid, an undecane acid, a dodecane acid, a tridecane acid, a tetradecane acid, a pentadecane acid, a hexadecane acid, a heptadecane acid, an octadecane acid, nonadecane acid, an icosane acid and an olein acid, and a so-called neo-acid having quaternary a carbon atom. Specific examples of the above are a valeric acid (n-pentane acid), a caproic acid (n-hexane acid), an enanthic acid (n-heptane acid), a caprylic acid (n-octane acid), a pelargonic acid (n-nonane acid), a capric acid (n-decane acid), an olein acid (cis-9-octadecene acid), an isopentane acid (3-methylbutane acid), a 2-methylhexane acid, a 2-ethylpentane acid, a 2-ethylhexane acid, a 3,5,5-trimethylhexane acid and the like.

The polyol ester may be a partial ester in which some hydroxyl groups of polyol remain unesterified, a full ester in which all the hydroxyl groups are esterified or a mixture of a partial ester and a full ester. The polyol ester is preferably a full ester.

Among the above polyol esters, ester of hindered alcohol such as neopentyl glycol, trimethylol ethane, trimethylol propane, trimethylol butane, di-(trimethylol propane), tri-(trimethylol propane), pentaerythritol, di-(pentaerythritol) and tri-(pentaerythritol) is preferable in view of hydrolytic stability. The polyol ester is more preferably ester of neopentyl glycol, trimethylol ethane, trimethylol propane, trimethylol butane or pentaerythritol. The polyol ester is the most preferably ester of pentaerythritol because ester of pentaerythritol is particularly excellent in the compatibility with the refrigerant and hydrolytic stability.

Preferable examples of the polyol ester-base compound are diester of neopentyl glycol and one or more aliphatic acid(s) selected from a group consisting of a valeric acid, a caproic acid, an enanthic acid, a caprylic acid, a pelargonic acid, a capric acid, an olein acid, an isopentane acid, a 2-methylhexane acid, a 2-ethylpentane acid, a 2-ethylhexane acid and a 3,5,5-trimethylhexane acid, triester of trimethylol ethane and one or more aliphatic acid(s) selected from a group consisting of a valeric acid, a caproic acid, an enanthic acid, a caprylic acid, a pelargonic acid, a capric acid, an olein acid, an isopentane acid, a 2-methylhexane acid, a 2-ethylpentane acid, a 2-ethylhexane acid and a 3,5,5-trimethylhexane acid, triester of trimethylol propane and one or more aliphatic acid(s) selected from a group consisting of a valeric acid, a caproic acid, an enanthic acid, a caprylic acid, a pelargonic acid, a capric acid, an olein acid, an isopentane acid, a 2-methylhexane acid, a 2-ethylpentane acid, a 2-ethylhexane acid and a 3,5,5-trimethylhexane acid, triester of trymethylol butane and one or more aliphatic acid(s) selected from a group consisting of a valeric acid, a caproic acid, an enanthic acid, a caprylic acid, a pelargonic acid, a capric acid, an olein acid, an isopentane acid, a 2-methylhexane acid, a 2-ethylpentane acid, a 2-ethylhexane acid and a 3,5,5-trimethylhexane acid, and tetraester of pentaerythritol and one or more aliphatic acid(s) selected from a group consisting of a valeric acid, a caproic acid, an enanthic acid, a caprylic acid, a pelargonic acid, a capric acid, an olein acid, an isopentane acid, a 2-methylhexane acid, a 2-ethylpentane acid, a 2-ethylhexane acid and a 3,5,5-trimethylhexane acid.

In the present invention, one of the polyol ester-base compounds may be singularly used or a combination of two or more thereof may be used.

When the polyol ester-base compound(s) is used as the base oil of the refrigerator oil composition according to the present invention, its kinematic viscosity at 40 degrees C. is preferably 1 to 400 $mm^2/s$, more preferably 5 to 250 $mm^2/s$.

(9) Ether-Base Compound

In the refrigerator oil composition according to the present invention, an ether-based compound having a structure represented by the following formula (2) is preferably used in the base oil.

$$Ra\text{-}[(ORb)n\text{-}(A)\text{-}(ORc)k]x\text{-}Rd \quad (2)$$

In the formula (2), Ra and Rd each represent a hydrogen atom, an alkyl group having 1 to 10 carbon atoms, an acyl group having 2 to 10 carbon atoms, or a hydrocarbon group having 2 to 6 bonding sites and 1 to 10 carbon atoms, Rb and Rc each represent an alkylene group having 2 to 4 carbon atoms, n and k each represent an integer in a range of 0 to 20, and x represents an integer in a range of 1 to 6. (A) represents a polymerization site containing 3 or more monomer units each represented by the following formula (3).

[Chemical Formula 6]

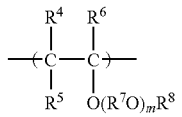

(3)

In the formula (3), $R^4$, $R^5$ and $R^6$ each represent a hydrogen atom or a hydrocarbon group having 1 to 8 carbon atoms. $R^4$, $R^5$ and $R^6$ may be mutually the same or different.

The hydrocarbon group specifically means an alkyl group of a methyl group, an ethyl group, an n-propyl group, an isopropyl group, an n-butyl group, an isobutyl group, a sec-butyl group, a tert-butyl group, pentyl groups, hexyl groups, heptyl groups or octyl groups, a cycloalkyl group of a cyclopentyl group, a cyclohexyl group, methylcyclohexyl groups, ethylcyclohexyl groups, dimethylcyclohexyl groups or the like, an aryl group of a phenyl group, methylphenyl groups, ethylphenyl groups or dimethylphenyl groups, or an arylalkyl group of a benzyl group, phenylethyl groups or methylbenzyl groups. $R^4$, $R^5$ and $R^6$ each preferably represent a hydrogen atoms in view of stability of synthesizing reaction.

On the other hand, $R^7$ represents a divalent hydrocarbon group having 1 to 10 carbon atoms or an ether-bonded oxygen-containing divalent hydrocarbon group having 2 to 20 carbon atoms. Examples of the divalent hydrocarbon group having 1 to 10 carbon atoms are: a divalent aliphatic group such as a methylene group, an ethylene group, a phenylethylene group, a 1,2-propylene group, a 2-phenyl-1,2-propylene group, a 1,3-propylene group, butylene groups, pentylene groups, hexylene groups, heptylene groups, octylene groups, nonylene groups or decylene groups; an alicyclic group having two bonding sites at an alicyclic hydrocarbon such as cyclohexane, methylcyclohexane, ethylcyclohexane, dimethylcyclohexane or propylcyclohexane; a divalent aromatic hydrocarbon group such as phenylene groups, methylphenylene groups, ethylphenylene groups, dimethylphenylene groups or naphthylene groups; an alkyl aromatic group having monovalent bonding sites respectively in an alkyl group portion and an aromatic group portion of alkyl aromatic hydrocarbon such as toluene, xylene, or ethylbenzene; and an alkyl aromatic group having a bonding site in an alkyl group portion of polyalkyl aromatic hydrocarbon such as xylene or diethylbenzene. Among the above, the aliphatic group having 2 to 4 carbon atoms is particularly preferable in view of the compatibility of the base oil with the refrigerant.

Preferable examples of the ether-bonded oxygen-containing divalent hydrocarbon group having 2 to 20 carbon atoms are a methoxymethylene group, a methoxyethylene group, a methoxymethylethylene group, a 1,1-bis-methoxymethylethylene group, a 1,2-bis-methoxymethylethylene group, an ethoxymethylethylene group, a (2-methoxyethoxy)methylethylene group, a (1-methyl-2-methoxy)methylethylene group and the like. In the formula (3), m represents the number of units $R^7O$, an average value of which is 0 to 10, preferably 0 to 5. When plural m are present, the plural m may be mutually the same or different per unit. When plural units of $R^7O$ are contained, the plural units of $R^7O$ may be mutually the same or different. When both k and n are 0, at least one of plural m is an integer of 1 or more in the formula (3).

$R^8$ represents a hydrogen atom or a hydrocarbon group having 1 to 20 carbon atoms. The hydrocarbon group specifically means an alkyl group of a methyl group, an ethyl group, an n-propyl group, an isopropyl group, an n-butyl group, an isobutyl group, a sec-butyl group, a tert-butyl group, pentyl groups, hexyl groups, heptyl groups, octyl groups, nonyl groups, decyl groups or the like, a cycloalkyl group of a cyclopentyl group, a cyclohexyl group, methylcyclohexyl groups, ethylcyclohexyl groups, propylcyclohexyl groups, dimethylcyclohexyl groups or the like, an aryl group of a phenyl group, methylphenyl groups, ethylphenyl groups, dimethylphenyl groups, propylphenyl groups, trimethylphenyl groups, butylphenyl groups, naphthyl groups or the like, or an arylalkyl group of a benzyl group, phenylethyl groups, methylbenzyl groups, phenylpropyl groups, phenylbutyl groups or the like. Plural $R^4$ to $R^8$ of the plural units may be mutually the same or different per unit.

By copolymerizing the ether-base compound having the monomer unit represented by the formula (3), lubricity, insulation properties, hygroscopicity and the like can be enhanced while a sufficient level of the compatibility with the refrigerant is retained. At this time, by suitably selecting a type of the monomer used as the material, a type of the initiator and a copolymer ratio, the level of the above performance of the refrigerator oil composition can be set at a target level. Accordingly, it is possible to obtain an oil composition that can exhibit required levels of lubricity and compatibility that vary depending on: types of compressors used in freezing or air-conditioning systems to which lubricating oil is applied; materials and freezing capabilities of lubricating portions; and types of refrigerants.

In the ether-base compound represented by the formula (2), (A) represents a polymerization site containing three or more monomer units each represented by the formula (3). The number of the monomer units (i.e., polymerization degree) can be suitably determined in accordance with a desired level of kinematic viscosity. The polymerization degree is typically determined so that the kinematic viscosity at 100 degrees C. becomes preferably 1 to 50 $mm^2/s$, more preferably 2 to 50 $mm^2/s$, further more preferably 5 to 50 $mm^2$, particularly preferably 5 to 20 $mm^2/s$.

Preferably in the ether-base compound represented by the formula (2), its mole ratio of carbon to oxygen (mole ratio of carbon/oxygen) is 4 or less. When the mole ratio is more than 4, the compatibility of the compound with a natural refrigerant such as carbon dioxide is deteriorated.

Instead of representing a homopolymer site containing the monomer units each represented by the formula (3), (A) in the formula (2) may represent a block copolymer site or a random copolymer site containing the monomer unit(s) represented by the formula (3) and monomer unit(s) represented by the following formula (7).

[Chemical Formula 7]

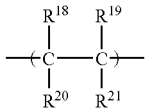

(7)

In the formula (7), $R^{18}$ to $R^{21}$ each represent a hydrogen atom or a hydrocarbon group having 1 to 20 carbon atoms. $R^{18}$ to $R^{21}$ may be mutually the same or different. Examples of the hydrocarbon group having 1 to 20 carbon atoms are the same as those of $R^8$ in the formula (3). In addition, $R^{18}$ to $R^{21}$ of plural monomer units may be mutually the same or different per monomer unit.

Polymerization degree of the ether-base compound represented by the formula (2), which contains a block or random copolymer containing the monomer unit(s) represented by the formula (3) and the monomer unit(s) represented by the formula (7), may be suitably determined in accordance with a desired level of kinematic viscosity. The polymerization degree is typically determined such that the kinematic viscosity at 100 degrees C. preferably becomes 5 $mm^2/s$ or more, more preferably 5 to 20 $mm^2/s$. Preferably in the ether-base compound, its mole ratio of carbon/oxygen is 4 or less. When the mole ratio is more than 4, the compatibility of the compound with a natural refrigerant such as carbon dioxide is deteriorated.

The above ether-base compound can be manufactured by polymerizing the relevant vinyl ether-base monomer or by copolymerizing the relevant hydrocarbon monomer having olefin double-bond(s) and the relevant vinyl ether-base monomer.

In view of stability of synthesizing reaction, the ether-base compound is preferably structured such that, in the formula (2), Ra represents a hydrogen atom and n equals to 0 at the first terminal of the compound while Rd represents a hydrogen atom and k equals to 0 at the second terminal of the compound.

Such an ether-base compound can be manufactured by performing such polymerization on a monomer as radical polymerization, cation polymerization or radiation polymerization. For instance, by polymerizing a vinyl ether-base monomer in accordance with the following method, the obtained polymer of the vinyl ether-base monomer can exhibit a desired level of viscosity. At the initial stage of the polymerization, a compound prepared by combining Bronsted acids, Lewis acids or organometallic compounds with water, alcohols, phenols, acetals or an adduct of vinyl ethers and a carboxylic acid may be used. Examples of the Bronsted acids are hydrofluoric acid, hydrochloric acid, hydrobromic acid, hydroiodic acid, nitric acid, sulfuric acid, trichloroacetic acid, trifluoroacetic acid and the like. Examples of the Lewis acids are boron trifluoride, aluminum trichloride, aluminum tribromide, tin tetrachloride, zinc dichloride, ferric chloride and the like, among which boron trifluoride is particularly preferable. Examples of the organometallic compounds are diethylaluminum chloride, ethylaluminum chloride, diethylzinc and the like.

Water, alcohols, phenols, acetals or an adduct of vinyl ethers and a carboxylic acid that is to be combined with the above may be suitably determined. Examples of the alcohols are saturated aliphatic alcohol having 1 to 20 carbon atoms such as methanol, ethanol, propanol, isopropanol, butanol, isobutanol, sec-butanol, tert-butanol, pentanols, hexanols, heptanols or octanols, unsaturated aliphatic alcohol having 3 to 10 carbon atoms such as aryl alcohol, monoether of alkylene glycol such as ethylene glycol monomethyl ether, diethylene glycol monomethyl ether, triethylene glycol monomethyl ether, propylene glycol monomethyl ether, dipropylene glycol monomethyl ether or tripropylene glycol monomethyl ether, and the like. Examples of the carboxylic acid used for preparing the adduct of vinyl ethers and the carboxylic acid are acetic acid, propionic acid, n-butyric acid, iso-butyric acid, n-valeric acid, iso-valeric acid, 2-methyl butyric acid, pivalic acid, n-caproic acid, 2,2-dimethyl butyric acid, 2-methyl valeric acid, 3-methyl valeric acid, 4-methyl valeric acid, enanthic acid, 2-methyl caproic acid, caprylic acid, 2-ethyl caproic acid, 2-n-propyl valeric acid, n-nonane acid, 3,5,5-trimethyl caproic acid, caprylic acid, undecane acid and the like.

It is preferable that the base oil is mineral oil or at least one synthetic base oil selected from a group consisting of alkyl benzene, alkyl naphthalene, poly-α-olefin, polyvinyl ether-base compound, polyoxyalkylene glycol-base compound, polycarbonate-base compound, polyol ester-base compound and a compound represented by the formula (2). The mineral oil or the synthetic base oil is preferably contained in the base oil of the refrigerator oil composition with a content of 50 mass % or more, more preferably 70 mass % or more, further preferably 90 mass % or more, particularly preferably 100 mass %.

In the present invention, a molecular weight of the synthetic base oil is preferably in a range of 150 to 5,000 in view of evaporation prevention, the flash point, performance as the refrigerator oil and the like, more preferably in a range of 500 to 3,000.

Next, a PAG block copolymer will be described.

The refrigerator oil composition according to the present invention contains base oil and a PAG block copolymer represented by the following formula (1).

$$R^1[(OR^2)_m(OE)_nOR^3]_1 \quad (1)$$

In the formula (1), $R^1$ represents a hydrocarbon residue having 1 to 10 carbon atoms. The hydrocarbon residue preferably has 1 to 8 carbon atoms in view of floc formation. Particularly, when the later-described "1" equals to one, $R^1$ preferably represents an alkyl group in view of compatibility with the refrigerant.

$R^2$ represents an alkylene group having 3 to 6 carbon atoms. Specifically, $R^2$ preferably represents propylene and/or a butylene group in view of adherability onto metal surface(s). E represents an ethylene group.

The PAG block copolymer used in the refrigerator oil composition according to the present invention is structured such that the group portion of $(OR^2)_m$ and the group portion of $(OE)_n$ are bonded in block form as the block copolymer literally means. Since a composition structured such that the $OR^2$ group and the OE group are polymerized in random exhibits less adherability onto metal surface(s) when added in the base oil, such a composition does not provide sufficient effects in reducing friction. In the formula, m and n each represent a positive integer. A ratio of m to n (ratio of m/n) equals to 99/1 to 50/50, preferably 80/20 to 50/50, more preferably 70/30 to 50/50. When the ratio of m/n is more than 99/1, the adherability onto metal surface(s) is unfavorably deteriorated. On the other hand, when the ratio of m/n is less than 50/50, floc is unfavorably formed.

In addition, while "1" represents an integer in a range of 1 to 100, "1" preferably represents an integer of m/n view of compatibility with the refrigerant.

$R^3$ represents a hydrogen atom or an alkyl group having 1 to 10 carbon atoms. In view of floc formation, $R^3$ preferably represents a hydrogen atom. In other words, the most preferable PAG block copolymer is a so-called copolymer terminated at one end.

In the present invention, the PAG block copolymer preferably has a mass average molecular weight of 200 to 5,000, more preferably 500 to 3,000. When the mass average molecular weight is less than 200, a molecular chain of the copolymer is shortened, so that the adherability is deteriorated. On the other hand, when the mass average molecular weight is more than 5,000, floc is unfavorably precipitated.

The PAG block copolymer preferably has viscosity at 40 degrees C. of 20 to 1,000 $mm^2/s$, more preferably 50 to 500 $mm^2/s$, further more preferably 100 to 300 $mm^2/s$. When the viscosity at 40 degrees C. is less than 20 $mm^2/s$, the adherability is unfavorably lost. On the other hand, when the viscosity at 40 degrees C. is more than 1,000 $mm^2/s$, such a copolymer is practically problematic because floc is easily precipitated and because viscosity when the copolymer is added to the composition becomes excessively high.

The PAG block copolymer is preferably contained in the composition with a content of 0.05 to 10 mass % of the total amount of the composition, more preferably 0.05 to 5 mass %, further more preferably 0.05 to 3 mass %. When the PAG block copolymer is contained in the composition with a content of less than 0.05 mass %, such a refrigerator oil composition does not provide sufficient effects in reducing friction coefficient or saving energy. On the other hand, when the PAG block copolymer is contained with a content of more than 10 mass %, such a refrigerator oil composition cannot be expected to provide enhanced effects in reducing friction coefficient or saving energy. On the contrary, floc may be formed.

The PAG block copolymer according to the present invention can be easily manufactured using alkylene oxide having 3 to 6 carbon atoms and ethylene oxide.

For instance, when a block copolymer containing butylene oxide and ethylene oxide is to be formed, the block polymerization is conducted such that butylene oxide is singularly polymerized initially and then ethylene oxide is added thereto while water or alkali hydroxide is used as the initiator. After obtaining a PAG block copolymer having hydroxyl groups at both terminals, both of the hydroxyl groups are etherified or esterified, or alternatively one of the hydroxyl groups is etherified while the other one of the hydroxyl groups is esterified, so that the PAG block copolymer represented by the formula (1) according to the present invention can be obtained.

The refrigerator oil composition according to the present invention may be added with at least one additive selected from a group consisting of an extreme pressure agent, an oiliness agent, an antioxidant, an acid scavenger, a copper deactivator and an antifoaming agent as long as an object of the present invention can be achieved.

Examples of the extreme pressure agent are phosphorus-base extreme pressure agents such as phosphate ester, acid phosphate ester, phosphite ester, acid phosphite ester and amine salts thereof.

Among the above phosphorus-base extreme pressure agents, tricresyl phosphate, trithiophenyl phosphate, tris (nonylphenyl) phosphate, dioleyl hydrogen phosphate, 2-ethylhexyl diphenyl phosphate and the like are particularly preferable in view of extreme pressure properties, friction characteristics and the like.

Another example of the extreme pressure agent is a metal salt of carboxylic acid. The metal salt of carboxylic acid is preferably a metal salt of carboxylic acid having 3 to 60 carbon atoms, more preferably a metal salt of carboxylic acid having 3 to 30 carbon atoms, particularly preferably a metal salt of aliphatic acid having 12 to 30 carbon atoms. The metal salt of carboxylic acid may be a metal salt of dimer acid or trimer acid of the aliphatic acid, or a metal salt of dicarboxylic acid having 3 to 30 carbon atoms. Among the above, a metal salt of aliphatic acid having 12 to 30 carbon atoms and a metal salt of dicarboxylic acid having 3 to 30 carbon atoms are particularly preferable.

On the other hand, a metal of the metal salt is preferably an alkali metal or an alkali earth metal. Particularly, an alkali metal is suitable.

Further examples of the extreme pressure agent other than the above-listed examples are sulfur-base extreme pressure agents such as sulfurized fat and oil, sulfurized aliphatic acid, ester sulfide, olefin sulfide, dihydrocarbyl polysulfide, thiocarbamates, thioterpenes, dialkylthiodipropionates and the like.

The extreme pressure agent is typically contained in the composition with a content of 0.001 to 5 mass % of the total amount of the composition, particularly preferably with a content of 0.005 to 3 mass %.

One of the above extreme pressure agents may be singularly used or a combination of two or more thereof may be used.

Examples of the oiliness agent other than the PAG block copolymer are saturated or unsaturated aliphatic monocarboxyl acid such as stearic acid or olein acid, dimerized aliphatic acid such as dimer acid or hydrogenated dimer acid, hydroxy aliphatic acid such as ricinoleic acid or 12-hydroxystearic acid, saturated or unsaturated aliphatic monoalcohol such as lauryl alcohol or oleyl alcohol, saturated or unsaturated aliphatic monoamine such as stearylamine or oleylamine, saturated or unsaturated aliphatic monocarboxylic amide such as lauric-acid amide or oleic amide, partial ester of multivalent alcohol such as glycerin or sorbitol and saturated or unsaturated aliphatic monocarboxyl acid, and the like.

One of the above oiliness agents may be singularly used or a combination of two or more thereof may be used. The oiliness agent is typically contained in the composition with a content of 0.01 to 10 mass % of the total amount of the composition, preferably with a content of 0.1 to 5 mass %.

Examples of the antioxidant are phenol-base antioxidant such as 2,6-di-tert-butyl-4-methylphenol, 2,6-di-tert-butyl-4-ethylphenol or 2,2'-methylenebis(4-methyl-6-tert-butylphenol) and amine-base antioxidant such as phenyl-α-naphthylamine or N,N'-diphenyl-p-phenylenediamine. In view of effects and cost, the antioxidant is typically contained in the composition with a content of 0.01 to 5 mass %, preferably with a content of 0.05 to 3 mass %.

Examples of the acid scavenger are epoxy compounds such as phenyl glycidyl ether, alkyl glycidyl ether, alkylene glycol glycidyl ether, cyclohexene oxide, α-olefin oxide and epoxidized soybean oil. Among the above, phenyl glycidyl ether, alkyl glycidyl ether, alkylene glycol glycidyl ether, cyclohexene oxide and α-olefin oxide are preferable in view of compatibility.

An alkyl group of alkyl glycidyl ether and an alkylene group of alkylene glycol glycidyl ether each may be branched, and each typically have 3 to 30 carbon atoms, preferably 4 to 24 carbon atoms, particularly preferably 6 to 16 carbon atoms. In addition, α-olefin oxide having 4 to 50 carbon atoms in total is typically used, α-olefin oxide having 4 to 24 carbon atoms in total is more preferably used, and α-olefin oxide having 6 to 16 carbon atoms in total is particularly preferably used. In the present invention, one of the above acid scavengers may be singularly used or a combination of two or more thereof may be used. In view of effects and sludge prevention, the acid scavenger is typically contained in the composition with a content of 0.005 to 5 mass % of the total amount of the composition, particularly preferably with a content of 0.05 to 3 mass %.

By adding such an acid scavenger to the composition, stability of the refrigerator oil composition according to the present invention can be more enhanced. By using the extreme pressure agent and the antioxidant together with the acid scavenger, the stability of the composition can be further more enhanced.

An example of the copper deactivator is N-[N',N'-dialkyl (alkyl group having 3 to 12 carbon atoms) aminomethyl] tolutriazole or the like. Examples of the antifoaming agent are silicone oil, fluorinated silicone oil and the like.

The refrigerator oil composition according to the present invention preferably has kinematic viscosity at 40 degrees C. of 1 to 400 $mm^2/s$, more preferably 3 to 300 $mm^2/s$, further more preferably 5 to 200 $mm^2/s$. Volume resistivity of the composition is preferably $10^9$ Ω·cm or more, more preferably $10^{10}$ Ω·cm or more, the upper limit of which is typically approximately 10 Ω·cm. Friction coefficient of the composition obtained through reciprocating friction test(s) is preferably 0.119 or less, more preferably 0.117 or less, further more preferably 0.112 or less, the lower limit of which is typically approximately 0.07.

Measuring methods of the kinematic viscosity and friction coefficient will be described later.

The refrigerator oil composition according to the present invention is applied to a freezer that uses a natural refrigerant such as carbon dioxide, ammonia, propane, butane or isobutane, a hydrofluorocarbon-base refrigerant such as R410A, R407C, R404A, R13a4 or R152a, a fluorine-containing organic compound-base refrigerant such as a unsaturated fluorohydrocarbon compound, a fluoroether compound, a fluoroalcohol compound or a fluoroketone compound, a refrigerant containing the fluorine-containing organic compound and a saturated fluorohydrocarbon compound, a refrigerant containing fluoromethyl iodide and propane, or the like.

In the method of lubricating a freezer that uses the refrigerator oil composition according to the present invention, used amounts of the refrigerant listed above and the refrigerator oil composition are preferably in a mass ratio (i.e., a mass ratio of the refrigerant/the refrigerator oil composition) of 99/1 to 10/99, more preferably at a mass ratio of 95/5 to 30/70. When the used amount of the refrigerant is less than the above mass ratio, the freezing capability of the refrigerant is unfavorably deteriorated. On the other hand, when the used amount of the refrigerant is more than the above mass ratio, the lubricating capability of the refrigerator oil composition is unfavorably deteriorated. The refrigerator oil composition according to the present invention is applicable to various types of freezers, particularly preferably applicable to a compression freezing cycles of a compression freezer.

Examples of a freezer (freezing system) to which the refrigerator oil composition according to the present invention is preferably applied are: a freezing system that includes a compressor, a condenser, an expansion mechanism (capillary tube, expansion valve) and an evaporator as essential components; a freezing system including an ejector cycle; and a freezing system including a dryer (desiccant: synthetic zeolite).

The above compressor may be open type, semi-hermetic type or hermetic type. A motor used in a hermetic-type compressor is an AC motor or a DC motor. The compressor may be a rotary compressor, a scroll compressor, a swing compressor or a piston compressor. The compressor may be a small compressor of approximately 0.2 kW or a large compressor of approximately 30 kW.

Examples of insulators are typically a polyethylene terephthalate resin and a polybutylene terephthalate resin.

In the freezing system, a water content within the system is preferably 500 ppm by mass or less, more preferably 300 ppm by mass or less. In addition, an air content therein is preferably 13 kPa or less, more preferably 1 kPa or less.

The freezer to which the refrigerator oil composition according to the present invention is applied includes a variety of slide portions (e.g., bearing) therein. In the present invention, slide portions made of engineering plastic or slide portions having organic coating layers or inorganic coating layers are used in view of sealability.

The engineering plastic is preferably, for instance, a polyamide resin, a polyphenylene sulfide resin, a polyacetal resin or the like in view of sealability, slidability, wear resistance and the like.

The organic coating layers each are preferably, for instance, a coating film of a fluorine-containing resin (e.g., coating film of polytetrafluoroethylene), a coating film of polyimide, a coating film of polyamide-imide or the like in view of sealability, slidability, wear resistance and the like.

On the other hand, the inorganic coating layers each are preferably, for instance, a graphite film, a diamond-like carbon film, a nickel film, a molybdenum film, a tin film, a chrome film, a nitride film, a boron film or the like in view of sealability, slidability, wear resistance and the like. The inorganic coating layers each may be formed by plating, CVD (chemical vapor deposition) or PVD (physical vapor deposition).

The slide portions each may be made of conventional alloy such as Fe-based alloy, Al-based alloy or Cu-based alloy.

The refrigerator oil composition according to the present invention has a lower friction coefficient and is excellent in energy saving, so that the refrigerator oil composition is favorably applied to compression freezers and freezing systems of various freezer fields (e.g., car air-conditioner, gas heat pump, air conditioner, refrigerator, vending machine, showcase, water heater, floor heater, heat pump of dryer for washer and the like).

EXAMPLES

Now, the present invention will be further described in detail by reference to Examples, which by no means limit the present invention.

Examples 1 to 17 and Comparatives 1 to 7

Refrigerator oil compositions respectively structured as shown in Tables 1 to 4 were prepared, and a friction coefficient and a power consumption reduction ratio (reduced power) of each composition were measured. The results of the measurement are also shown in Tables 1 to 4.

Characteristics of each refrigerator oil composition were obtained by the following methods.

(1) Kinematic Viscosity of Base Oil and Refrigerator Oil Composition at 40° C.

Kinematic viscosity at 40 degrees C. was measured based on JIS (abbreviation of Japanese Industrial Standard) K2283.

(2) Friction Coefficient

Reciprocating friction test(s) was conducted under the following conditions so as to measure a friction coefficient.

<Test Conditions>

Test Piece: cylinder SUJ2 (ϕ 4.5 mm by 5.3 mm)/plate FC250

Load: 49N

Speed: 25 mm/s

Temperature: ambient temperature (20 degrees C.)

Stroke: 10 mm (3) Power Consumption Reduction Ratio

Using the refrigerator oil composition according to Comparative 1 as a reference oil, a power consumption reduction ratio (reduced power (W): 90 Hz) of each actual machine was measured so as to evaluate energy-saving capability.

Power consumption reduction ratio(%)=(Power Consumption of Comparative 1−Power Consumption of Target Oil)/(Power Consumption of Comparative 1)*100

Test conditions are as follows.

<Test Conditions>

Machine: rotary compressor (three-phase −200V)

Discharge Pressure: 2.4 MPa

Syctuib Pressure: 1.37 MPa

Frequency: 30 Hz

Tested Oil: 420 g

R410A (refrigerant): 1200 g

TABLE 1

| | | | Example 1 | Example 2 | Example 3 | Example 4 | Example 5 | Example 6 |
|---|---|---|---|---|---|---|---|---|
| Content (mass %) | Base oil | A1 | Residue | Residue | Residue | Residue | Residue | Residue |
| | | A2 | | | | | | |
| | | A3 | | | | | | |
| | | A4 | | | | | | |
| | | A5 | | | | | | |
| | | A6 | | | | | | |

TABLE 1-continued

| | | | Example 1 | Example 2 | Example 3 | Example 4 | Example 5 | Example 6 |
|---|---|---|---|---|---|---|---|---|
| | PAG block polymer | B1 | 1.0 | | | | | |
| | | B2 | | 1.0 | | | | |
| | | B3 | | | 1.0 | | | |
| | | B4 | | | | 1.0 | | |
| | | B5 | | | | | 1.0 | |
| | | B6 | | | | | | 1.0 |
| | | B7 | | | | | | |
| | | B8 | | | | | | |
| | | B9 | | | | | | |
| | | B10 | | | | | | |
| | | B11 | | | | | | |
| | | B12 | | | | | | |
| | | B13 | | | | | | |
| | Extreme pressure agent | C1 | 1.0 | 1.0 | 1.0 | 1.0 | 1.0 | 1.0 |
| | Acid scavenger | C2 | 1.0 | 1.0 | 1.0 | 1.0 | 1.0 | 1.0 |
| | Antioxidant | C3 | 0.5 | 0.5 | 0.5 | 0.5 | 0.5 | 0.5 |
| | Antifoaming agent | C4 | 0.001 | 0.001 | 0.001 | 0.001 | 0.001 | 0.001 |
| Kinematic viscosity at 40° C. | | | 68.3 | 68.6 | 69.2 | 68.3 | 68.5 | 69.1 |
| Friction coefficient | | | 0.117 | 0.115 | 0.111 | 0.116 | 0.114 | 0.109 |
| Reduced power (%): 90 Hz | | | 0.50 | 0.63 | 0.75 | 0.63 | 0.75 | 0.88 |

TABLE 2

| | | | Example 7 | Example 8 | Example 9 | Example 10 | Example 11 | Example 12 |
|---|---|---|---|---|---|---|---|---|
| Content (mass %) | Base oil | A1 | Residue | Residue | Residue | Residue | Residue | Residue |
| | | A2 | | | | | | |
| | | A3 | | | | | | |
| | | A4 | | | | | | |
| | | A5 | | | | | | |
| | | A6 | | | | | | |
| | PAG block polymer | B1 | | | | | | |
| | | B2 | | | | | | |
| | | B3 | | | | | | |
| | | B4 | | | | | | |
| | | B5 | | | | | | |
| | | B6 | | | | | | |
| | | B7 | 1.0 | | | | | |
| | | B8 | | 1.0 | | | | |
| | | B9 | | | 1.0 | | | |
| | | B10 | | | | 1.0 | | |
| | | B11 | | | | | 1.0 | |
| | | B12 | | | | | | 1.0 |
| | | B13 | | | | | | |
| | Extreme pressure agent | C1 | 1.0 | 1.0 | 1.0 | 1.0 | 1.0 | 1.0 |
| | Acid scavenger | C2 | 1.0 | 1.0 | 1.0 | 1.0 | 1.0 | 1.0 |
| | Antioxidant | C3 | 0.5 | 0.5 | 0.5 | 0.5 | 0.5 | 0.5 |
| | Antifoaming agent | C4 | 0.001 | 0.001 | 0.001 | 0.001 | 0.001 | 0.001 |
| Kinematic viscosity at 40° C. | | | 68.4 | 68.7 | 69.3 | 68.3 | 68.6 | 69.2 |
| Friction coefficient | | | 0.114 | 0.112 | 0.106 | 0.109 | 0.108 | 0.105 |
| Reduced power (%): 90 Hz | | | 0.63 | 0.75 | 0.88 | 0.63 | 0.75 | 0.81 |

TABLE 3

| | | | Example 13 | Example 14 | Example 15 | Example 16 | Example 17 |
|---|---|---|---|---|---|---|---|
| Content (mass %) | Base oil | A1 | | | | | |
| | | A2 | Residue | | | | |
| | | A3 | | Residue | | | |
| | | A4 | | | Residue | | |
| | | A5 | | | | Residue | |
| | | A6 | | | | | Residue |
| | PAG block polymer | B1 | | | | | |
| | | B2 | | | | | |
| | | B3 | | | | | |
| | | B4 | | | | | |
| | | B5 | 1.0 | 1.0 | 1.0 | 1.0 | 1.0 |
| | | B6 | | | | | |

TABLE 3-continued

| | | Example 13 | Example 14 | Example 15 | Example 16 | Example 17 |
|---|---|---|---|---|---|---|
| | B7 | | | | | |
| | B8 | | | | | |
| | B9 | | | | | |
| | B10 | | | | | |
| | B11 | | | | | |
| | B12 | | | | | |
| | B13 | | | | | |
| Extreme pressure agent | C1 | 1.0 | 1.0 | 1.0 | 1.0 | 1.0 |
| Acid scavenger | C2 | 1.0 | 1.0 | 1.0 | 1.0 | 1.0 |
| Antioxidant | C3 | 0.5 | 0.5 | 0.5 | 0.5 | 0.5 |
| Antifoaming agent | C4 | 0.001 | 0.001 | 0.001 | 0.001 | 0.001 |
| Kinematic viscosity at 40° C. | | 46.9 | 75.6 | 69.0 | 68.6 | 102.0 |
| Friction coefficient | | 0.116 | 0.112 | 0.113 | 0.114 | 0.115 |
| Reduced power (%): 90 Hz | | 0.56 | 0.88 | 0.81 | 0.75 | 0.69 |

TABLE 4

| | | | Comparative 1 | Comparative 2 | Comparative 3 | Comparative 4 | Comparative 5 | Comparative 6 | Comparative 7 |
|---|---|---|---|---|---|---|---|---|---|
| Content (mass %) | Base oil | A1 | Residue | | | | | | Residue |
| | | A2 | | Residue | | | | | |
| | | A3 | | | Residue | | | | |
| | | A4 | | | | Residue | | | |
| | | A5 | | | | | Residue | | |
| | | A6 | | | | | | Residue | |
| | PAG block polymer | B1 | | | | | | | |
| | | B2 | | | | | | | |
| | | B3 | | | | | | | |
| | | B4 | | | | | | | |
| | | B5 | | | | | | | |
| | | B6 | | | | | | | |
| | | B7 | | | | | | | |
| | | B8 | | | | | | | |
| | | B9 | | | | | | | |
| | | B10 | | | | | | | |
| | | B11 | | | | | | | |
| | | B12 | | | | | | | |
| | | B13 | | | | | | | 1.0 |
| | Extreme pressure agent | C1 | 1.0 | 1.0 | 1.0 | 1.0 | 1.0 | 1.0 | 1.0 |
| | Acid scavenger | C2 | 1.0 | 1.0 | 1.0 | 1.0 | 1.0 | 1.0 | 1.0 |
| | Antioxidant | C3 | 0.5 | 0.5 | 0.5 | 0.5 | 0.5 | 0.5 | 0.5 |
| | Antifoaming agent | C4 | 0.001 | 0.001 | 0.001 | 0.001 | 0.001 | 0.001 | 0.001 |
| Kinematic viscosity at 40° C. | | | 68.2 | 46.8 | 75.4 | 68.7 | 67.3 | 101.5 | 68.2 |
| Friction coefficient | | | 0.122 | 0.128 | 0.122 | 0.120 | 0.121 | 0.124 | 0.121 |
| Reduced power (%): 90 Hz | | | — | −0.50 | 0.25 | 0.25 | 0.00 | −0.25 | 0.13 |

REMARKS

Base oil used is as follows.

A1: Polyvinyl ether (PVE), kinematic viscosity at 40° C. of 68.1 $mm^2/s$

A2: Polyoxyalkylene glycol (PAG), kinematic viscosity at 40° C. of 46.7 $mm^2/s$ A3: Copolymer of polyvinyl ether and polyalkylene glycol (mole ratio of 1:1), kinematic viscosity at 40° C. of 75.2 $mm^2/s$ A4: Polyol ester (POE), kinematic viscosity at 40° C. of 68.5 $mm^2/s$ A5: Polycarbonate (PC), kinematic viscosity at 40° C. of 67.9 $mm^2/s$ A6: Mineral oil, kinematic viscosity at 40° C. of 101 $mm^2/s$ PAG block copolymers used each were a copolymer terminated at one end in which a polyoxybutylene group and a polyoxyethylene group were bonded together in block form, a specific structure of which is as follows. B1 to B12 are PAG block copolymers included in the present invention while B13 is a PAG random copolymer.

B1: n-BuO-$((BO)_m/(EO)_n)$—H, m/n=95/5, kinematic viscosity at 40° C. of 100 $mm^2/s$ B2: n-BuO-$((BO)_m/(EO)_n)$—H, m/n=95/5, kinematic viscosity at 40° C. of 200 $mm^2/s$ B3: n-BuO-$((BO)_m/(EO)_n)$—H, m/n=95/5, kinematic viscosity at 40° C. of 500 $mm^2/s$ B4: n-BuO-$((BO)_m/(EO)_n)$—H, m/n=90/10, kinematic viscosity at 40° C. of 100 $mm^2/s$ B5: n-BuO-$((BO)_m/(EO)_n)$—H, m/n=90/10, kinematic viscosity at 40° C. of 200 $mm^2/s$ B6: n-BuO-$((BO)_m/(EO)_n)$—H, m/n=90/10, kinematic viscosity at 40° C. of 500 $mm^2/s$ B7: n-BuO-$((BO)_m/(EO)_n)$—H, m/n=80/20, kinematic viscosity at 40° C. of 100 $mm^2/s$ B8: n-BuO-$((BO)_m/(EO)_n)$—H, m/n=80/20, kinematic viscosity at 40° C. of 200 $mm^2/s$ B9: n-BuO-$((BO)_m/(EO)_n)$—H, m/n=80/20, kinematic viscosity at 40° C. of 500 $mm^2/s$ B10: n-BuO-$((BO)_m/(EO)_n)$—H, m/n=50/50, kinematic viscosity at 40° C. of 100 $mm^2/s$ B11: n-BuO-$((BO)_m/(EO)_n)$—H, m/n=50/50, kinematic viscosity at 40° C. of 200 $mm^2/s$ B12: n-BuO-$((BO)_m/(EO)_n)$—H, m/n=50/50, kinematic viscosity at 40° C. of 500 $mm^2/s_2$ B13: n-BuO-$((BO)_m/(EO)_n)$—H, m/n=90/10, kinematic viscosity at 40° C. of 200 $mm^2/s$ Additives added to base oil are as follows.

C1: Extreme pressure agent (tricresyl phosphate (TCP))

C2: Acid scavenger (α-olefin oxide having 14 carbon atoms)

C3: Antioxidant (2,6-di-tert-butyl-4-methylphenol (DBPC))

C4: Antifoaming agent (silicone-base antifoaming agent)

[Evaluation Result]

According to Tables 1 to 4, since the refrigerator oil composition according to the present invention contains a predetermined PAG block copolymer, not only its friction coefficient is small but also its power consumption reduction ratio (reduced energy) is large (i.e., the refrigerator oil composition according to the present invention is excellent in energy-saving effects). On the other hand, the friction coefficient of the refrigerator oil composition according to each of Comparatives 1 to 6 is high, and the refrigerator oil composition according to each Comparative provides no energy-saving effect. In addition, since the refrigerator oil composition according to Comparative 7 contains the random copolymer in place of the PAG block copolymer, its friction coefficient is high and the refrigerator oil composition according to Comparative 7 provides no energy-saving effect.

The invention claimed is:

1. A refrigerator oil composition, comprising:

a base oil; and a polyalkylene glycol (PAG) block copolymer;

wherein the PAG block copolymer is represented by formula (1):

$$R^1[(OR^2)_m(OE)_nOR^3]_l \quad (1)$$

where: $R^1$ represents a hydrocarbon residue having 1 to 10 carbon atoms; $R^2$ represents a butylene group; E represents an ethylene group; $R^3$ represents a hydrogen atom; m and n each represent a positive integer, the ratio of min being 95/5 to 50/50; and l represents an integer in a range of 1 to 100; and wherein the base oil is mineral oil and/or synthetic base oil, and the synthetic base oil is at least one compound selected from the group consisting of alkyl benzene, alkyl naphthalene, poly-α-olefin, polyvinyl ether, polyalkylene glycol, polycarbonate, and an ether-base compound represented by formula (2):

$$Ra\text{-}[(ORb)n\text{-}(A)\text{-}(ORc)kJx\text{-}Rd \quad (2)$$

where: Ra and Rd each represent a hydrogen atom, an alkyl group having 1 to 10 carbon atoms, an acyl group having 2 to 10 carbon atoms or a hydrocarbon group having 2 to 6 bonding sites and 1 to 10 carbon atoms; Rb and Rc each represent an alkylene group having 2 to 4 carbon atoms; n and k each represent an integer in a range of 0 to 20; x represents an integer in a range of 1 to 6; and (A) represents a polymerization site comprising three or more monomer units each represented by formula (3):

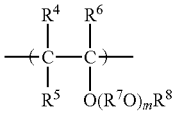

(3)

where: $R^4$, $R^5$ and $R^6$ each represent a hydrogen atom or a hydrocarbon group having 1 to 8 carbon atoms, $R^4$, $R^5$ and $R^6$ being allowed to be mutually the same or different; $R^7$ represents a divalent hydrocarbon group having 1 to 10 carbon atoms or a divalent ether-bonded oxygen-containing hydrocarbon group having 2 to 20 carbon atoms; $R^8$ represents a hydrogen atom, or a hydrocarbon group having 1 to 20 carbon atoms; m represents a number whose average value is in a range of 0 to 10; when plural m are present, the plural m are allowed to be mutually the same or different per unit; $R^4$ to $R^8$ each are allowed to be mutually the same or different per unit; when plural $R^7O$ are present, the plural $R^7O$ are allowed to be mutually the same or different; and when k and n in formula (2) both represent 0, one of plural m in formula (3) represents an integer of 1 or more.

2. The refrigerator oil composition according to claim 1, wherein a mass average molecular weight of the PAG block copolymer is 200 to 5,000.

3. The refrigerator oil composition according to claim 1, wherein the PAG block copolymer is contained in the refrigerator oil composition at a content of 0.05 to 10 mass % of the total amount of the refrigerator oil composition.

4. The refrigerator oil composition according to claim 1, further comprising at least one additive selected from the group consisting of an extreme pressure agent, an oiliness agent, an antioxidant, an acid scavenger, a copper deactivator and an antifoaming agent.

5. The refrigerator oil composition according to claim 1, wherein kinematic viscosity of the refrigerator oil composition at 40 degrees C. is 1 to 400 $mm^2/s$.

6. The refrigerator oil composition according to claim 1, wherein the friction coefficient of the refrigerator oil composition is 0.119 or less, the friction coefficient being obtained through a reciprocating friction test.

7. The refrigerator oil composition according to claim 1, wherein the base oil is a mixture of the mineral oil and the synthetic base oil.

8. The refrigerator oil composition according to claim 1, wherein the base oil comprises said mineral oil.

9. The refrigerator oil composition according to claim 1, wherein the base oil comprises said synthetic base oil.

10. The refrigerator oil composition according to claim 9, wherein the base oil comprises said ether-base compound represented by formula (2).

11. The refrigerator oil composition according to claim 9, wherein the base oil comprises at least one compound selected from the group consisting of said alkyl benzene, said alkyl naphthalene, said poly-α-olefin, said polyvinyl ether, said polyalkylene glycol, and said polycarbonate.

12. A lubrication method for lubricating a refrigerator using a refrigerant containing an unsaturated fluorohydrocarbon compound, the method comprising lubricating the refrigerator with an oil composition, wherein the oil composition comprises:

a base oil; and a polyalkylene glycol (PAG) block copolymer;

wherein the PAG block copolymer is represented by formula (1):

$$R^1[(OR^2)_m(OE)_nOR^3]_l \quad (1)$$

where: $R^1$ represents a hydrocarbon residue having 1 to 10 carbon atoms; $R^2$ represents a butylene group; E represents an ethylene group; $R^3$ represents a hydrogen atom; m and n each represent a positive integer, the ratio of m/n being 95/5 to 50/50; and l represents an integer in a range of 1 to 100; and wherein the base oil is mineral oil and/or synthetic base oil, and the synthetic base oil is at least one compound selected from the group consisting of alkyl benzene, alkyl naphthalene, poly-α-olefin, polyvinyl ether, polyalkylene glycol, polycarbonate, and an ether-base compound represented by formula (2):

$$Ra\text{-}[(ORb)n\text{-}(A)\text{-}(ORc)kJx\text{-}Rd \quad (2)$$

where: Ra and Rd each represent a hydrogen atom, an alkyl group having 1 to 10 carbon atoms, an acyl group having 2 to 10 carbon atoms or a hydrocarbon group having 2 to 6 bonding sites and 1 to 10 carbon atoms; Rb and Rc each represent an alkylene group having 2 to 4 carbon atoms; n and k each represent an integer in a range of 0 to 20; x represents an integer in a range of 1 to 6; and (A) represents a polymerization site comprising three or more monomer units each represented by formula (3):

(3)

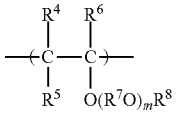

where: $R^4$, $R^5$ and $R^6$ each represent a hydrogen atom or a hydrocarbon group having 1 to 8 carbon atoms, $R^4$, $R^5$ and $R^6$ being allowed to be mutually the same or different; $R^7$ represents a divalent hydrocarbon group having 1 to 10 carbon atoms or a divalent ether-bonded oxygen-containing hydrocarbon group having 2 to 20 carbon atoms; $R^8$ represents a hydrogen atom, or a hydrocarbon group having 1 to 20 carbon atoms; m represents a number whose average value is in a range of 0 to 10; when plural m are present, the plural m are allowed to be mutually the same or different per unit; $R^4$ to $R^8$ each are allowed to be mutually the same or different per unit; when plural $R^7O$ are present, the plural $R^7O$ may be mutually the same or different; and when k and n in formula (2) both represent 0, one of plural m in formula (3) represents an integer of 1 or more.

13. The lubrication method according to claim 12, wherein the refrigerant is a mixture of an unsaturated fluorohydrocarbon compound and a saturated fluorohydrocarbon compound.

* * * * *